US006679938B1

(12) United States Patent
Kim et al.

(10) Patent No.: US 6,679,938 B1
(45) Date of Patent: Jan. 20, 2004

(54) METHOD OF PRODUCING METAL PARTICLES BY SPRAY PYROLYSIS USING A CO-SOLVENT AND APPARATUS THEREFOR

(75) Inventors: Jung Hyeun Kim, College Park, MD (US); Sheryl H. Ehrman, College Park, MD (US); Thomas A. Germer, Gaithersburg, MD (US); George W. Mulholland, Gaithersburg, MD (US); Eric B. Steel, Gaithersburg, MD (US)

(73) Assignees: University of Maryland, College Park, MD (US); The United States of America as represented by the Secretary of Commerce, Washington, DC (US)

( * ) Notice: Subject to any disclaimer, the term of this patent is extended or adjusted under 35 U.S.C. 154(b) by 34 days.

(21) Appl. No.: 10/055,912

(22) Filed: Jan. 28, 2002

Related U.S. Application Data

(60) Provisional application No. 60/264,514, filed on Jan. 26, 2001.

(51) Int. Cl.[7] ..... B22F 9/24

(52) U.S. Cl. ..... 75/365; 75/369

(58) Field of Search ..... 75/363, 365, 369

(56) References Cited

U.S. PATENT DOCUMENTS

| | | | | |
|---|---|---|---|---|
| 5,421,854 A | | 6/1995 | Kodas et al. | 75/355 |
| 5,429,657 A | * | 7/1995 | Glicksman et al. | 75/351 |
| 5,439,502 A | * | 8/1995 | Kodas et al. | 75/365 |
| 5,514,202 A | * | 5/1996 | Lin et al. | 75/351 |
| 5,616,165 A | * | 4/1997 | Glicksman et al. | 75/369 |
| 5,861,136 A | | 1/1999 | Glicksmann et al. | 423/604 |
| 5,906,670 A | * | 5/1999 | Dobson et al. | 75/370 |
| 5,984,997 A | * | 11/1999 | Bickmore et al. | 75/343 |
| 6,277,169 B1 | | 8/2001 | Hampden-Smith et al. | 75/336 |
| 6,316,100 B1 | | 11/2001 | Kodas et al. | 428/357 |
| 6,530,972 B2 | * | 3/2003 | A Kimoto | 75/351 |

OTHER PUBLICATIONS

Nagashima et al., Chemical Society of Japan, 1990, 1, pp. 17–24.

D. Majumdar et al., Copper (I) oxide powder generation by spray pyrolysis, *Journal of Materials Research*, vol. 11, No. 11, Nov. 1996 pp. 2861–2868.

B. Xia et al., The roles of ammonia and ammonium bicarbonate in the preparation of nickel particles from nickel chloride, *Materials Research Society*, vol. 15, No. 10, Oct. 2000, pp. 2157–2166.

Mulholland et al., Measurement of the 100 nm NIST SRM 1963 by Differential Mobility Analysis, *Aerosol Science and Technology*, Jul. 1999, pp. 39–55.

Kazuro Nagashima et al., Preparation of fine Ni particles by the spray–pyrolysis technique and their film forming properties in the thick film method, *Materials Research Society*, vol. No. 12,. 5, Dec. 1990, pp. 2828–2834.

* cited by examiner

*Primary Examiner*—George Wyszomierski
(74) *Attorney, Agent, or Firm*—Wenderoth, Lind & Ponack, L.L.P.

(57) ABSTRACT

A spray pyrolysis method for producing pure metal and/or metal oxide particles uses a mixture of a carrier gas and a solution of a metal salt precursor, water and a co-solvent reducing agent. The metal salt precursors preferably comprise metals from the group consisting of Fe, Co, Ni, Cu, Zn, Pd, Ag and Au, whereas the salt anions preferably comprise nitrates, acetates, oxalates and chlorides. The co-solvents are those that act as a reducing agent, are vaporizable, are inert with respect to the carrier gas, and are hydrophilic, such as alcohols, in particular, low-carbon numbered alcohols such as methanol or ethanol.

23 Claims, 13 Drawing Sheets

CENTER ROD
CENTER ROD
EXIT SLIT
302
304
306
308
309
310
310
220
$\psi_1$
$\psi_2$
$\psi_3$
$\psi_4$ Peak ID Extended Report (20 Peaks. Max P/N = 19.5)
[COPPER10.RD] COPPER 10
PEAK: 39-pts/Parabolic Filter. Threshold=3.0. Cutoff=0.1%. BG=3/1.0. Peak-Top=Summit

| 2-Theta | d(A) | Intensity | I% | Phase ID | d(A) | I% | h | k | l | 2-Theta |
|---|---|---|---|---|---|---|---|---|---|---|
| | Delta | | | | | | | | | |
| 29.576 | 3.0178 | 91 | 5.8 | Cuprite | 3.0200 | 9.0 | 1 | 1 | 0 | 29.554 | -0.022 |
| 32.523 | 2.7508 | 20 | 1.3 | Tenorite | 2.7520 | 13.0 | 1 | 1 | 0 | 32.508 | -0.015 |
| 35.584 | 2.5209 | 53 | 3.4 | Tenorite | 2.5237 | 100.0 | 1 | 1 | -1 | 35.543 | -0.041 |
| 36.417 | 2.4651 | 1574 | 100.0 | Cuprite | 2.4650 | 100.0 | 1 | 1 | 1 | 36.418 | 0.002 |
| 38.821 | 2.3178 | 66 | 4.2 | Tenorite | 2.3131 | 21.0 | 2 | 0 | 0 | 38.902 | 0.081 |
| 42.322 | 2.1338 | 579 | 36.8 | Cuprite | 2.1350 | 37.0 | 2 | 0 | 0 | 42.297 | -0.025 |
| 43.334 | 2.0863 | 1488 | 94.5 | Copper | 2.0880 | 100.0 | 1 | 1 | 1 | 43.297 | -0.038 |
| 50.450 | 1.8074 | 515 | 32.7 | Copper | 1.8080 | 46.0 | 2 | 0 | 0 | 50.433 | -0.017 |
| 61.397 | 1.5088 | 375 | 23.8 | Cuprite | 1.5100 | 27.0 | 2 | 2 | 0 | 61.344 | -0.053 |
| 73.550 | 1.2866 | 222 | 14.1 | Cuprite | 1.2870 | 17.0 | 3 | 1 | 1 | 73.526 | -0.024 |
| 77.391 | 1.2321 | 102 | 6.5 | Cuprite | 1.2330 | 4.0 | 2 | 2 | 2 | 77.323 | -0.068 |
| 89.907 | 1.0902 | 271 | 17.2 | Copper | 1.0900 | 17.0 | 3 | 1 | 1 | 89.931 | 0.024 |
| 92.518 | 1.0662 | 19 | 1.2 | Cuprite | 1.0674 | 2.0 | 4 | 0 | 0 | 92.380 | -0.138 |
| 95.154 | 1.0435 | 68 | 4.3 | Copper | 1.0436 | 5.0 | 2 | 2 | 2 | 95.139 | -0.015 |
| 103.647 | 0.9799 | 79 | 5.0 | Cuprite | 0.9795 | 4.0 | 3 | 3 | 1 | 103.701 | 0.054 |

Peak ID Extended Report (5 Peaks. Max P/N = 49.5)
[COPPER12.RD] COPPER 12
PEAK: 39-pts/Parabolic Filter. Threshold=3.0. Cutoff=0.1%. BG=3/1.0. Peak-Top=Summit

| 2-Theta | d(A) | Intensity | I% | Phase ID | d(A) | I% | h | k | l | 2-Theta |
|---|---|---|---|---|---|---|---|---|---|---|
| | Delta | | | | | | | | | |
| 43.343 | 2.0859 | 9830 | 100.0 | Copper | 2.0880 | 100.0 | 1 | 1 | 1 | 43.297 | -0.046 |
| 50.479 | 1.8065 | 3850 | 39.2 | Copper | 1.8080 | 46.0 | 2 | 0 | 0 | 50.433 | -0.046 |
| 74.151 | 1.2777 | 2548 | 25.9 | Copper | 1.2780 | 20.0 | 2 | 2 | 0 | 74.130 | -0.021 |
| 89.960 | 1.0897 | 2692 | 27.4 | Copper | 1.0900 | 17.0 | 3 | 1 | 1 | 89.931 | -0.030 |
| 95.157 | 1.0435 | 768 | 7.8 | Copper | 1.0436 | 5.0 | 2 | 2 | 2 | 95.139 | -0.018 |

X-ray Diffraction Spectra

Copper Nitrate with Ethanol in $H_2O$

X-ray Diffraction Spectra

Copper Acetate in $H_2O$

Cu: 600 °C

Cu: 1000 °C

METHOD OF PRODUCING METAL PARTICLES BY SPRAY PYROLYSIS USING A CO-SOLVENT AND APPARATUS THEREFOR

This application claims priority under 35 U.S.C. §119(e) from provisional U.S. application Ser. No. 60/264,514, filed Jan. 26, 2001, the entire disclosure of which is incorporated herein by reference.

STATEMENT REGARDING GOVERNMENT RIGHTS

This invention was made with Government support under Contract No. 70NANB0H0015 awarded by the NIST. The Government has certain rights in this invention.

BACKGROUND OF THE INVENTION

1. Field Of The Invention

The present invention is drawn to a spray pyrolysis method for producing particles and an apparatus for performing the method. Specifically, the present invention is drawn to a spray pyrolysis method for producing pure metal particles and/or metal oxide particles without using a reducing gas such as hydrogen or carbon monoxide. More specifically, the present invention is drawn to a spray pyrolysis method for producing uniform sized monodispersed particles, particularly microparticles or nanoparticles of a pure metal and/or a metal oxide, from a mixture of a carrier gas and a solution of a metal salt precursor, water and a co-solvent.

2. Description Of Related Art

Metal nanoparticles are of interest for a variety of applications because of their unique chemical, electrical, and optical properties. These applications include catalysis, conducting pastes, templates, and size standards for calibration of optical scattering instruments used by various industries to inspect materials for surface quality. Surface defects such as particulate contaminants and surface roughness, as well as substrate defects, are of great concern for quality control of products such as semiconductor devices, magnetic storage media and flat panel displays. As device dimensions shrink, detection of these defects plays an increasingly important role in increasing product yield. Most studies of defect detection have used optical scattering of dielectric materials such as polystyrene latex (PSL) spheres. Solutions consisting of suspensions of size-monodispersed PSL particles are commercially available, and the PSL particles can easily be deposited onto wafers.

However, it is unlikely that PSL particles are representative of actual industrial process contaminants. Furthermore, the interaction of light between particles and a silicon substrate is much simpler for dielectric materials than for other materials such as metals. A need exists for methods of producing uniform size-monodisperse ("monodispersed") particles of other materials, particularly metals, which may be deposited onto wafer surfaces for use as optical scattering standards and for evaluating light scattering theories.

Presently in the electronics industry, metal particles have been used in the formation of conductive pastes. These particles, however, have mainly been obtained through chemical precipitation from a solution of metal salt precursor. In order to improve production yield, use of a continuous process such as spray pyrolysis is desirable. However, the reduction of metal oxide, produced from metal precursors, to form pure metal particles is a challenging problem.

The spray process method, which is composed of a carrier gas, an aerosol generator, and a high temperature reactor, has been studied by several research groups. For example, Nagashima et al., *Chemical Society of Japan*, 1990, 1, 17 and Majumdar et al., *Journal of Material Research*, 1996, 11, 2861, the entire disclosures of which are incorporated herein by reference, disclose using hydrogen gas as a reducing agent to obtain pure metal particles from various aqueous metal salt systems. However, these methods may be very dangerous in high temperature conditions (above 500° C.) because of the explosive property of hydrogen that creates a significant fire hazard. The ignition energy for a hydrogen-air mixture is much lower than for hydrocarbon-air mixtures. Therefore, very low energy sparks such as from a static electric discharge can lead to ignition; furthermore, if the burning gas is even slightly confined, the resulting pressure rise can lead to a detonation.

Several research groups have used hydrogen gas in spray pyrolysis as a reducing gas. Further Xia et al., *J. Mater. Res.*, 2000, 15, 2157, discloses using a co-solvent, ammonium bicarbonate to produce pure Ni particles from an aqueous Ni chloride solution, whereas Nagashima et al., J. Mater. Res., 1990, 12, 2828, discloses using $Ni(NO_3)_2$ and $NiCl_2$ aqueous solutions in an $H_2$—$N_2$ atmosphere to produce fine Ni particles. The entire disclosures of these references are incorporated herein by reference.

Copper metal particles have been produced using hydrogen to reduce metal oxide particles formed by spray pyrolysis of copper salt precursors. In these prior art processes, because the concentration of hydrogen required to reduce the metal oxide particles is greater than the flammability limit of hydrogen in the air, a potential safety hazard results.

U.S. Pat. No. 6,316,100 to Kodas et al. (the '100 patent), discloses a method for producing nickel metal powders. The entire disclosure of the '100 patent is incorporated herein by reference. The teachings and specific embodiments discloses therein may be used with the present invention.

The '100 patent is drawn to a method of producing nickel particles that are substantially spherical, have a weight average particle size of not greater than about five gm, a narrow particle size distribution and high crystallinity. The reference is directed to generating an aerosol of droplets including a nickel metal precursor and moving the droplets through a heating zone of 700° C.–1400° C. to form nickel particles. Embodiments of the reference use a hydrogen, nitrogen and a hydrogen-nitrogen mixture carrier gas. As such, the methods disclosed in the reference may be very dangerous in high temperature conditions for the reasons as stated above with respect to hydrogen. What is needed is a more efficient, less hazardous, method of forming pure nickel particles.

U.S. Pat. No. 5,421,854, also to Kodas et al. (the '854 patent), discloses a method for manufacturing finely divided particles of palladium, palladium oxide or mixtures thereof The entire disclosure of the '854 patent is incorporated herein by reference. The disclosed teachings and specific embodiments therein may be used with the present invention.

The '854 patent discloses a first step of forming an unsaturated solution of a thermally decomposable palladium-containing compound in a thermally volatizable solvent. The reference teaches a following step of forming an aerosol consisting essentially of finely divided droplets of the solution in an air carrier gas. The reference then teaches a third step of heating the aerosol between 300° C. and 950° C., wherein palladium oxide is formed at temperatures between 300° C. and 800° C., and pure palladium is formed only at temperatures between 800° C. and 950° C. What is needed is a more efficient method of forming pure palladium particles.

U.S. Pat. No. 5,861,136 to Glicksman et al. (the '136 patent), discloses a method for manufacturing fully dense, finely divided, spherical particles of copper I oxide ($Cu_2O$) and copper II oxide (CuO) powders. The entire disclosure of the '136 reference is incorporated herein by reference. The specific teachings and exemplary embodiments therein may be used with the present invention.

The '136 patent discloses a first step of forming an unsaturated solution of a thermally decomposable copper containing compound in a thermally volatilizable solvent wherein the copper containing compound is used in concentrations not below 0.002 mole/liter or not higher than 90% of saturation, and wherein the particle size of copper I oxide is an approximate function of the cube root of the concentration of the unsaturated solution. The reference teaches a second step of forming an aerosol consisting essentially of finely divided for droplets of the solution in an inert carrier gas. The reference teaches a third step of heating the aerosol, to an operating temperature of at least 1,000° C., wherein the copper containing compound is decomposed to form the copper II oxide (CuO), and the copper II oxide is decomposed to formed pure phase copper I oxide ($Cu_2O$) particles. This reference does not disclose a method for producing pure copper particles.

U.S. Pat. No. 6,277,169 to Hampton-Smith et al. (the '169 patent), discloses a method of providing high quality, micro-size silver-containing particles of a variety of compositions having carefully controlled particle size and size distribution, and an aerosol method for producing the particles. The entire disclosure of the '169 patent is incorporated herein. The teachings and exemplary embodiments of the reference may be used with the present invention.

The process of the '169 patent involves processing of a high-quality aerosol including a silver-containing precursor. The aerosol includes droplets of controlled size suspended in and carried by a carrier gas. In a thermal reactor having temperatures ranging from 900° C. to 1400° C., the liquid of the droplets are vaporized, permitting formation of the desired Pd/Ag particles in an aerosol state. An aerosol at a high droplet loading and at a high metric flow rate is fed to a reactor, where Pd/Ag particles are formed. This reference does not disclose a method for producing pure palladium or pure silver particles.

Another prior art method for generating nanoparticles includes using a solution of a copper salt and water with an inert carrier gas. In particular, in one method, copper acetate in a solution of water is used in a spray pyrolysis system to generate copper nanoparticles. Specifically, the solution of copper nitrate is first dehydrated, as described below in equation (1):

$$Cu(NO_3)_2 \cdot 2.5H_2O \rightarrow Cu(NO_3)_2 + 2.5H_2O. \quad (1)$$

The dried copper nitrate is then thermally decomposed into copper II oxide in accordance with the following equation (2):

$$Cu(NO_3)_2 \rightarrow CuO + 2NO_2 + 0.5O_2. \quad (2)$$

The copper II oxide is then reduced by heating the material up to approximately 1000° C., which yields copper I oxide and pure copper, in accordance with the following equation (3):

$$5CuO \rightarrow 2Cu_2O + Cu + 1.5O_2. \quad (3)$$

The problem with the prior art method for decomposition of copper nitrate as discussed above with respect to equations (1)–(3), is that the copper II oxide must be heated up to 1000° C., which is not efficient. Furthermore, the prior art method of decomposing copper nitrate yields two moles of copper I oxide for every one mole of pure copper. As such, the method is not preferable when the desired outcome is pure copper metal nanoparticles.

Another prior art method for decomposition of copper includes use of a solution of copper acetate and water in combination with an inert carrier gas. In particular, the copper acetate solution is first dehydrated in accordance with the following equation (4):

$$Cu(CH_3COO)_2.H_2O \rightarrow Cu(CH_3COO)_2 + H_2O. \quad (4)$$

The dried copper acetate is then thermally decomposed to copper I oxide in accordance with the following equation (5):

$$2Cu(CH_3COO)_2 \rightarrow Cu_2O + CO_2 + \text{others}. \quad (5)$$

The copper I oxide is then reduced by heating the material above approximately 600° C., thereby yielding pure copper particles, in accordance with the following equation (6):

$$2Cu_2O \rightarrow 4Cu + O_2. \quad (6)$$

What is needed is a method for decomposing copper from copper acetate without heating the copper I oxide at temperatures above 600° C.

What is also needed is a method for producing metal particles, in particular metal nanoparticles, without the use of hydrogen gas as a reducing agent.

What is additionally needed is a method for making metal particles having a uniform particle size. In particular, what is additionally needed is a method for making pure metal particles having a uniform particle size. More particularly, what is additionally needed is a method for making pure metal nanoparticles having a size distribution that is within a predetermined range.

What is further needed is a method for producing metal particles, in particular metal nanoparticles, more efficiently, i.e., at heating temperatures lower than those of the prior art methods.

BRIEF DESCRIPTION OF THE INVENTION

It is an object of the present invention to provide metal particles, in particular metal nanoparticles, without the use of hydrogen gas as a reducing agent.

It is an object of the present invention to provide metal particles having a uniform particle size. In particular, it is an object of the present invention to provide pure metal particles having a uniform particle size. More particularly, it is an object of the present invention to provide pure metal microparticles, more preferably nanoparticles, having a size distribution that is within a predetermined range.

It is an object of the present invention to provide metal particles, in particular metal nanoparticles, more efficiently, i.e., at heating temperatures lower than those of the prior art methods.

The present invention provides a method and apparatus for producing metal particles comprising generating aerosol droplets of a solution in an inert carrier gas, and heating the aerosol with a heater thereby forming metal particles, wherein the solution comprises a metal precursor, water and co-solvent reducing agent.

In accordance with one embodiment of the present invention, the metal precursor comprises any one of the group consisting of Fe, Co, Ni, Cu, Zn, Pd, Ag and Au.

In accordance with another embodiment of the present invention, the metal precursor comprises Cu or Ni.

In accordance with another embodiment of the present invention, the co-solvent reducing agent is an organic compound having 1 to 5 carbon atoms.

In accordance with another embodiment of the present invention, the co-solvent is an alcohol. Preferably, the alcohol is present in an amount of about 5% to about 30% by volume of the solution.

In accordance with another embodiment of the present invention, the co-solvent is methanol or ethanol.

In accordance with another embodiment of the present invention, the metal salt precursor is present in an amount of about 0.2 mol/liter to about 2.5 mol/liter, preferably 0.3 mol/liter to about 0.35 mol/liter, of the solution.

In accordance with another embodiment of the present invention, the metal particles are pure metal nanoparticles.

In accordance with another embodiment of the present invention, the metal particles have a diameter within the range of about 50 nm to about 200 nm.

In accordance with another embodiment of the present invention, the water is deionized water.

In accordance with another embodiment of the present invention, the inert carrier gas comprises nitrogen gas.

In accordance with another embodiment of the present invention, the method further comprises passing the heated aerosol through a bipolar charger to obtain metal particles with a Boltzmann charge distribution. Preferably, the method still further comprises passing the heated aerosol through a differential mobility analyzer.

In accordance with another embodiment of the present invention, the step of generating aerosol droplets of a solution further comprises flowing the solution into an atomizer at a flow rate of 20 mL/hr, flowing the inert carrier gas into the atomizer at flow rate of 5 L/min, and atomizing the solution and the inert carrier gas with the atomizer.

In accordance with another embodiment of the present invention, the step of heating comprises passing the aerosol through a two-zone furnace thereby forming metal particles by solvent evaporation and precursor decomposition.

In accordance with another embodiment of the present invention, the step of heating is conducted at a temperature within the range from about 300° C. to about 1600° C.

In accordance with another embodiment of the present invention, the step of heating is conducted at a temperature within the range from about 450° C. to about 800° C.

In accordance with another embodiment of the present invention, the inert carrier comprises nitrogen gas.

In accordance with another embodiment of the present invention, the aerosol droplets of solution are dried prior to heating. Preferably, the step of drying comprises passing the aerosol droplets through a screen having a desiccant deposited thereon.

The present invention further comprises a product coated with metal nanoparticles, wherein the metal nanoparticles are produced by the method of generating aerosol droplets of a solution in an inert carrier, drying the aerosol droplets with a drier to obtain a dried aerosol, and heating the dried aerosol with a heater thereby forming metal nanoparticles, and wherein the solution comprises a metal precursor, water and a co-solvent reducing agent.

The present invention further comprises an improvement in a spray pyrolysis method for producing metal nanoparticles from a solution comprising a metal salt precursor and water, wherein the improvement comprises using a co-solvent reducing agent in the solution.

Additional objects, advantages and novel features of the invention are set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate exemplary embodiments of the present invention and, together with the description, serve to explain the principles of the invention. In the drawings:

FIG. 5A is an electron microscope picture of size classified poly-dispersed copper (Cu) particles obtained from an exemplary embodiment of the present invention, whereas

FIG. 6A is a graph depicting X-ray diffraction spectra of the resulting copper particles and copper oxide particles produced from a reduction of a solution of a copper nitrate and water, whereas

FIG. 7A is a graph depicting X-ray diffraction spectra of the resulting particles produced from a reduction of a solution of copper nitrate and water, whereas

FIG. 8A is a graph depicting X-ray diffraction spectra of the resulting particles produced from a reduction of a solution of copper acetate and water, whereas

FIG. 9A is an electron microscope image of pure copper particles formed from copper nitrate with a co-solvent at a temperature of 600° C. in accordance with an embodiment of the present invention, whereas

DETAILED DESCRIPTION OF THE INVENTION

Figure 1:
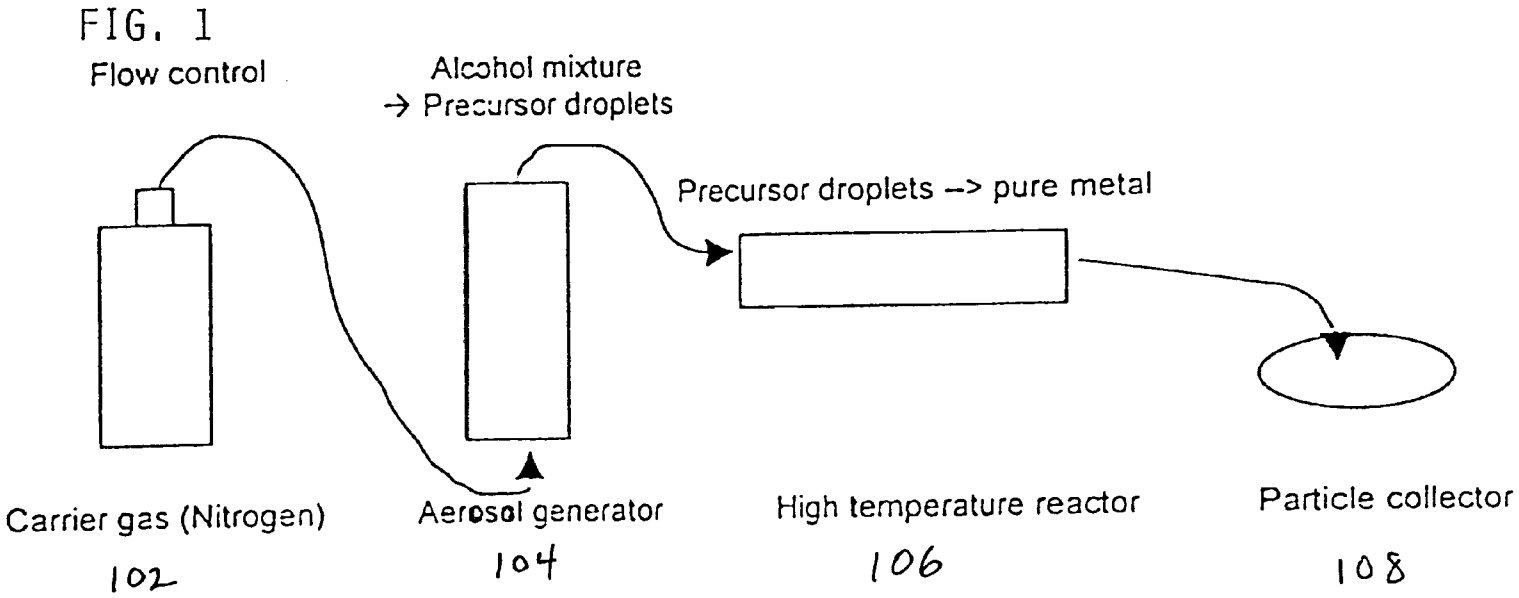
FIG. 1 is a block diagram depicting the stages of production of the nanoscale particles in accordance with an exemplary embodiment of the present invention.

The method of the present invention produces metal nanoparticles without the use of a reducing gas. In particular, the method involves generating aerosol droplets of a solution in an inert carrier gas, and heating the aerosol with a heater thereby forming metal particles. More particularly, the solution comprises a metal salt precursor, water and a co-solvent reducing agent.

The metal salt precursors of the present invention are those that are inert with respect to the carrier gas and do not precipitate out of the solution in a reaction with the co-solvent. In the non-limiting exemplary embodiments of the present invention, the metal salt precursors preferably comprise metal cations from the group consisting of Fe, Co, Ni, Cu, Zn, Pd, Ag and Au, whereas the salt anions preferably comprise nitrates, acetates, oxalates and chlorides.

The amount of metal salt precursors that are present in the solution may vary depending on the intended particle population density produced. In particular, as the amount of metal salt precursor present in the solution is high, the particle population density that is produced is correspondingly high. Similarly, as the amount of metal salt precursor present in the solution is low, the particle population density that is produced is correspondingly low. Generally, the amount of metal salt precursors that are present in the solution may vary in an amount from 0.001 mol/liter to about 95% of the saturation limit of the corresponding metal salt precursor in the solution. Preferably the amount of metal salt precursors that are present in the solution is about 0.30 mol/liter to 0.35 mol/liter.

The co-solvents of the present invention are those that act as a reducing agent of a metal oxide, are vaporizable, are inert with respect to the carrier gas, are hydrophilic, and have a carbon number from 1 to 5 carbon atoms. In the non-limiting exemplary embodiments of the present invention, the co-solvents may comprise alcohols, esters, ethers, ketones, such as for example acetone, etc. The preferred co-solvent is a low-carbon numbered alcohol such as methanol or ethanol. Co-solvents of the present invention do not include hydrogen gas and ammonium bicarbonate.

The co-solvents are present in the solution in an amount from 1% to 50% by volume, preferably 5% to 30% by volume, and more preferably 5% to 20% by volume.

The carrier gas may be any gas, which is inert to the components of the solution, preferably nitrogen gas.

The water contained in the solution is preferably deionized and/or degassed water.

The heating temperature of the system varies with the choice of metal salt precursor and/or co-solvent. Generally the heating temperature used with the method and apparatus of the present invention is in the range of 300° C. to 1600° C., preferably 450° C. to 1100° C., more preferably to 600° C. to 800° C.

The duration of heating varies with the choice of metal salt precursor and/or co-solvent. The duration may be any length of time necessary to cause solvent evaporation and precursor decomposition to form the pure metal nanoparticles, or metal oxide nanoparticles if desired. Generally the duration of heating is from 1 to 5 seconds. The duration of heating additionally varies depending upon whether the aerosol solution is dried, partly dried or not dried prior to heating. If the amount of drying prior to heating is decreased, or if there is no drying prior to heating, then the duration of heating to reduce the solution to the desired metal particles and/or metal oxide particles will be increased.

The metal nanoparticles produced by the present invention are preferably pure metal nanoparticles, but may include metal oxide nanoparticles if desired. The nanoparticles have a particle size of from 10 nm to 300 nm, preferably 50 nm to 200 nm, more preferably 80 nm to 120 nm.

One exemplary embodiment of the present invention includes a method of forming pure copper nanoparticles from a mixture of an inert carrier gas and a solution of copper nitrate, water, and ethanol. In particular, the dehydration and decomposition of the copper nitrate in accordance with this exemplary embodiment of the present invention is similar to that as described above with respect to equations (1) and (2) with the exception that the present invention includes the use of ethanol as a co-solvent. As a result, the present invention reduces the copper II oxide, as provided for example in equation (2), to pure copper nanoparticles by heating the solution above 600° C., as described below in equation (7):

$$6CuO+C_2H_5OH \rightarrow 6Cu+3H_2O+2CO_2. \quad (7)$$

As described above, by using ethanol as a co-solvent in accordance with the exemplary embodiment, pure copper nanoparticles are produced from copper nitrate, as opposed to copper I oxide particles that are produced in accordance with the prior art method discussed earlier. Furthermore, the method of the present invention reduces the heating temperature from up to 1000° C., as with the prior art method in equation (2), to about 600° C. Therefore, the method of the present invention additionally is more efficient over that of the prior art method.

Another exemplary embodiment of the present invention includes a method of forming pure copper nanoparticles from mixture of an inert carrier gas and a solution of copper acetate, water, and ethanol. In particular, the dehydration and decomposition of the copper acetate in accordance with the this exemplary embodiment of the present invention is similar to that as described above with respect to equations (4) and (5) with the exception that the present invention includes the use of ethanol, as the co-solvent. As a result, the present invention reduces the copper I oxide, as provided for example in equation (5), to pure copper nanoparticles by heating the solution above 450° C., as described below in equation (8):

$$6Cu_2O+C_2H_5OH \rightarrow 12Cu+3H_2O+2CO_2. \quad (8)$$

As described above, by using ethanol as the co-solvent in accordance with this exemplary embodiment, pure copper nanoparticles are produced from copper acetate, more efficiently than that of the prior art method discussed earlier. In particular, the method in accordance with this embodiment of the present invention reduces the heating temperature from up to 600° C., as with the prior art method in equation (5), to about 450° C.

As described above in the exemplary embodiments, the use of an alcohol co-solvent enables production of pure copper at reduced reaction temperatures. Furthermore, as evident in equations (7) and (8), the use of an alcohol co-solvent decreases the amount of oxides in the powders.

In another exemplary embodiment of the present invention, nickel nitrate was reduced to pure Ni particles and NiO particles using a spray pyrolysis method. In particular, a mixture of a nitrogen carrier gas and a solution of nickel nitrate, water, and 30% by volume ethanol was heated to about 900° C. A higher concentration of ethanol was used to form the Ni particles because nickel oxide has a higher bond energy than that of copper oxide. Consequently, a stronger reducing atmosphere is needed in order to reduce the higher oxide bond metals into corresponding pure metal particles, without relying on high temperatures as in the prior art methods. The addition of the co-solvent decreases the amount of oxide in the powders, thereby enabling production of pure nickel particles without the addition of a hazardous reducing gas.

As discussed earlier, nanoparticles that are produced with a spray pyrolysis system may be detected, for example with a low pressure impactor. In particular, the nanoparticles may be deposited on a substrate for imaging and counting via an optical microscope. Alternatively, a condensation nucleus counter may be used to count the nanoparticles by measuring the intensity of light scattered by the nanoparticles.

The particles formed by the spray pyrolysis system may be analyzed in the following manner. Once, the particles are collected, for example with a filter, the powdered particles are placed in a solvent, for example an alcohol, to form a suspension. The suspension is then placed as a particle film on a glass substrate, which is then examined by x-ray diffraction. Every type of particle will have an associated lattice structure. Further, each lattice structure of a particle has a 2-theta (measured in °) signature, which is a particular set of angles for which the x-rays are diffracted. A comparison between a detected 2-theta signature, from a particle formed by the spray pyrolysis system, and known 2-theta signatures will identify the composition of the particle.

FIG. 1 is a block diagram depicting the stages of production of metal particles in accordance with an exemplary embodiment of the present invention. In particular, stage 102 depicts a flow control of a carrier gas. A non-limiting example of a carrier gas may be nitrogen, however, any inert gas may be used. As depicted in FIG. 1, stage 102 provides the carrier gas to the aerosol generator 104. The aerosol generator 104 generates an aerosol mixture of the carrier gas, and a solution of a metal salt precursor, water and a co-solvent. The aerosol generated by the aerosol generator 104 is then provided to a reactor 106, for example a high temperature reactor, wherein the precursor droplets may be reduced to pure metal particles. Of course, depending upon the desired product, the reactor may be operated so as to provide metal oxide particles or a combination of pure metal and metal oxide particles. In any event, the particles produced by reactor 106 are collected in a particle collector 108. Furthermore, an optional drying stage may be added prior to the reactor 106. The addition of a drying stage would extract excess water from the aerosol, and may therefore decrease the amount of energy needed in the reactor to produce the desired metal particles.

Figure 2:
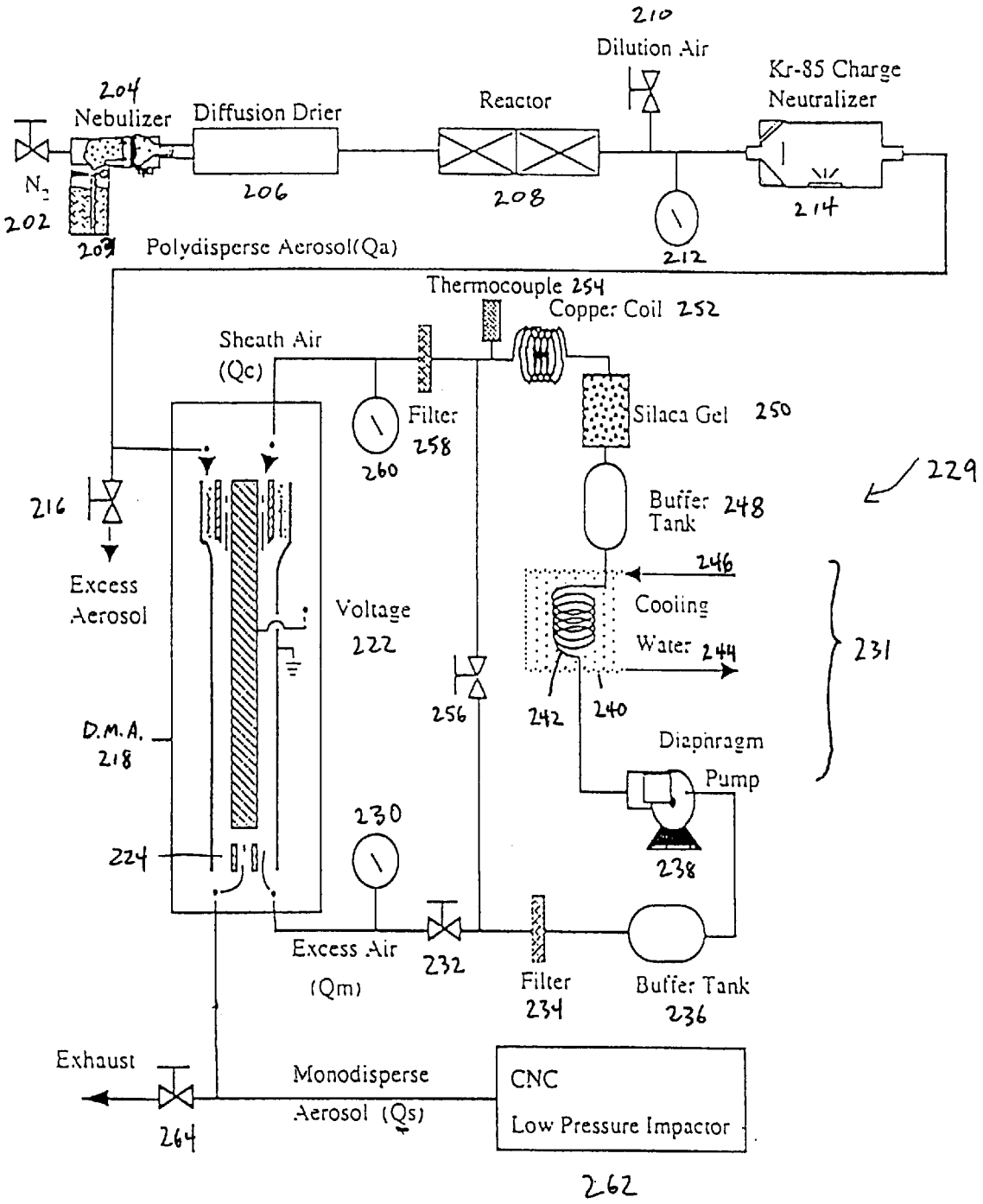
FIG. 2 is a diagram of a spray pyrolysis system for generating nanoscale particles in accordance with the present invention.

A more detailed discussion of a method for forming nanoscale particles in accordance with the present invention will now be discussed with reference to the spray pyrolysis system for generating nanoscale particles, as depicted in FIG. 2. In particular, the following discussion with respect to FIG. 2 is drawn to an exemplary embodiment of the present invention, wherein pure copper nanoparticles are formed with a combination of an aerosol solution comprising a copper solute, a water solvent and an alcohol co-solvent.

As illustrated in FIG. 2, a nitrogen carrier gas is externally provided by way of value 202 to a nebulizer 204. A container 203 supplies a solution of the metal salt precursor, water and the co-solvent to nebulizer 204.

The nebulizer 204 mixes the solution provided from container 203 and the carrier gas provided by valve 202 into a fine aerosol spray that flows into a diffusion dryer 206. A non-limiting example of a diffusion dryer includes a screen tube containing a silica gel desiccant for extracting excess water. The dried aerosol droplets then flow from the diffusion dryer 206 to a heater 208, wherein metal nanoparticles are formed by solvent evaporation and precursor decomposition. A non-limiting example of a heater includes a quartz tube that may be externally heated by a horizontal 2-zone furnace, for example a Lindberg furnace type 55035. The flow of nanoparticles from heater 208 is then diluted with air by way of valve 210 to cool the flow of heated particles so as not to damage any other portions of the system. The amount of air used to dilute the flow of heated particles additionally affects the distribution of the sizes of the particle. In particular, as the amount of diluted air mixed with the flow of heated particles increases, the overall average particle size decreases. Similarly, as the amount of diluted air mixed with the flow of heated particles decreases, the overall average of the particle size increases. As such, the system may be operated so as to provide a particle size distribution that is generally below (or above if the case may be) a predetermined threshold.

Pressure gauge 212 measures the pressure of the fluid flow between the heater 208 and a bi-polar charger 214. The bi-polar charger 214, for example a radioactive KR-85 charge neutralizer, strips the unwanted charges that may result from friction between the particles during the heating process, while at the same time, places desired charges on the metal nanoparticles. The amount of charge placed on the particles is in direct relation to the size of the particle. Therefore, an aerosol with polydispersed nanoparticles having a Boltzmann charge distribution exits the bi-polar charger 214. The particles are polydispersed because they include a combination of multiple sized particles. Furthermore the multiple sized particles have multiple sized charges, respectively.

Excess aerosol may then be extracted by valve 216, whereas the remaining flow of polydispersed particles is then directed into a differential mobility analyzer ("DMA") 218, for example a D.M.A. TSI Inc., Model 3071, in order to separate the polydispersed particles from the remainder of the fluid. A detailed description of a structure and operation of a DMA may be found in Mulholland et al., *Aerosol Science and Technology*, 1999, 31, 39–55, the entire disclosure of which is incorporated herein by reference.

Figures 3A, 3B:
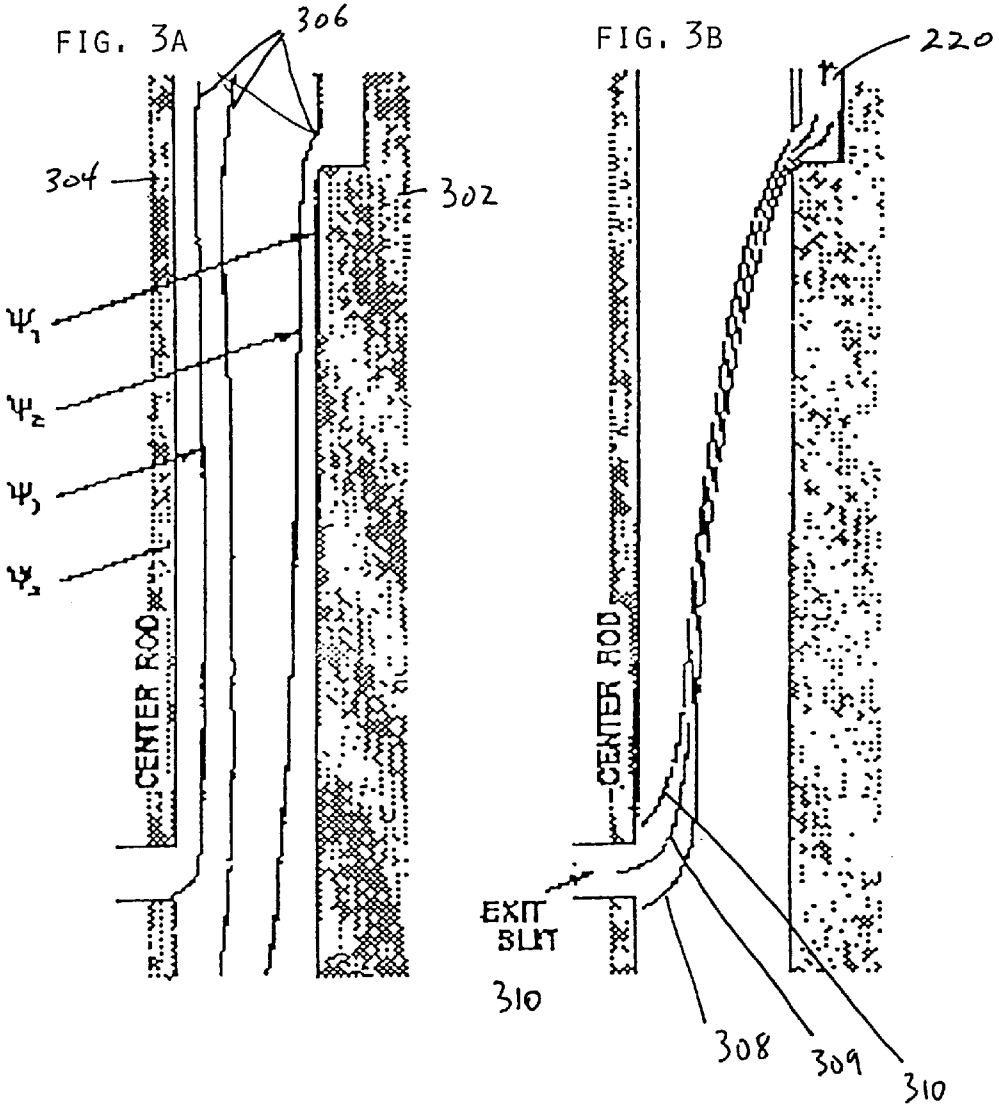
FIG. 3A is an exploded view of a portion of a DMA of the spray pyrolysis system of FIG. 2, which depicts the streamlines of the aerosol flow therein.
FIG. 3B is an exploded view of a portion of a DMA of the spray pyrolysis system of FIG. 2, which depicts the particle path therein.

A general description of the DMA 218 in accordance with the present invention will now be described with reference to FIG. 3A and FIG. 3B. As the flow of polydispersed particles enter the DMA 218 at entrance 220, the aerosol flow generally follows the path indicated by lines 306. A radial electric field is generated between the center rod 304 and the concentric outer conductor 302 as a result of the voltage applied by voltage source 222 (FIG. 2). The electric field acts on the polydispersed particles thereby forcing the particles to flow generally in the paths indicated by lines 308–310. In particular, the voltage from the voltage source 222 may be set so as to generate an electric field that will have a specified strength so as to move particles of a predetermined charge, which was provided by the bi-polar charger 214, into exit slit 310, along path 309. Once this voltage is set, the particles having a charge that is below the predetermined charge will follow path 308, whereas particles having a charge above the predetermined charge will follow path 310. Consequently, only the particles of the predetermined charge, which have a corresponding size, i.e. a monodispersed aerosol, will exit the DMA 218.

The monodispersed aerosol that exits the DMA 218 at exhaust port 224 may then be ultimately used, by way of a valve 264, or it may be directed to a collection device 262, a non-limiting example of which includes a low pressure impactor used in conjunction with an optical microscope for counting the number of particles.

The DMA 218 may additionally include an aerosol recycling portion 229. The aerosol recycling portion 229 includes gauge 230, valve 232, filter 234, buffer tank 236, cooling system 231, buffer tank 248, water extracting compartment 250, coil 252, sensor 254, filter 258, gauge 260 and valve 256. Gauge 230, for example, may be a pressure gauge for measuring the fluid pressure as the aerosol enters the aerosol recycling portion 229. Valve 232, for example, may be an on/off valve for controlling the amount of aerosol that enters the aerosol recycling portion 229. Filter 234, for example, may be any type of filter that extracts unwanted components from aerosol that has entered the aerosol recycling portion 229. Buffer tank 236, for example, may be any compartment having a sufficient volume so as to provide a buffer to compensate for dynamic changes in pressure of the aerosol in the aerosol recycling portion 229. Cooling system 231, for example, may be any cooling system that cools the aerosol in the aerosol recycling portion 229. The cooling system 231, for example, may include diaphragm pump 238, cooling tank 240, coil 242, cooling water input 246, and cooling water output 244. Buffer tank 248, for example, may be any compartment having a sufficient volume so as to provide a buffer to compensate for dynamic changes in pressure of the aerosol leaving the cooling system 231. Water extracting compartment 250, for example, may be any compartment operable to extract water that was condensed in the aerosol leaving the cooling system 231. In an exemplary embodiment of the present invention, the extracting compartment 250 includes a compartment filled with a desiccant, such as for example, a silica gel. A heat exchanging coil 252, for example a copper coil, is further provided to regulate the temperature of the aerosol in the aerosol recycling portion 229. Sensor 254, for example, may be a thermocouple for measuring the temperature of the aerosol in the aerosol recycling portion 229 after it has been cooled by the cooling system 231. Filter 258, for example, may be any type of filter that further extracts unwanted components from aerosol that will enter the DMA 218 at port 228. Gauge 260, for example, may be a pressure gauge for measuring the fluid pressure of the aerosol that will enter the DMA 218 at port 228. Valve 256, for example, may be a by-pass valve operable to permit the aerosol that enters the aerosol recycling portion 229 to bypass the cooling system 231, and thereby re-enter the DMA 218 at port 228.

Figure 4:
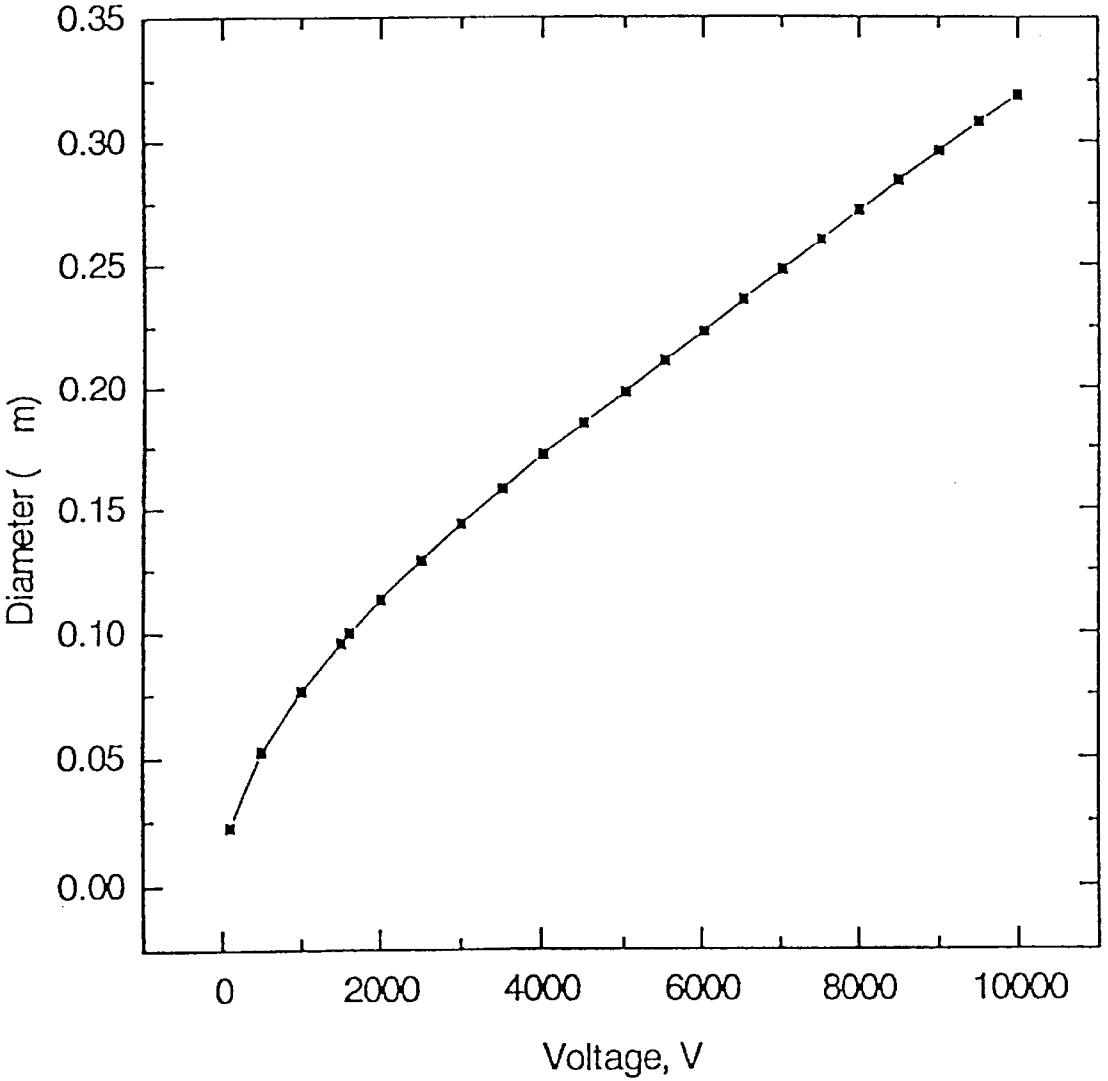
FIG. 4 is a graph of the particle size passed through the DMA vs. the applied voltage of the DMA in accordance with an exemplary embodiment of the present invention.

FIG. 4 is a graph of the particle size passed through the DMA vs. the applied voltage of the DMA, as described above, in accordance with an exemplary embodiment of the present invention.

Figure 5B:
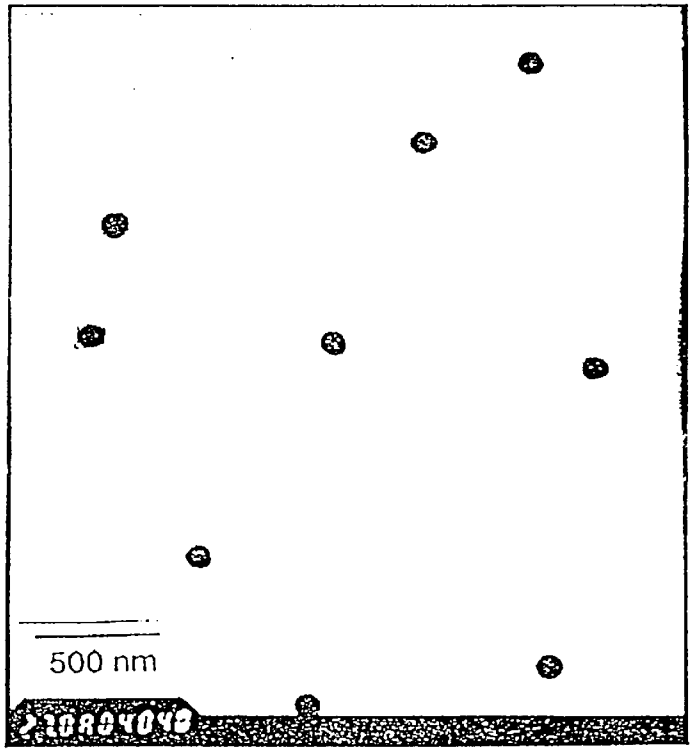
FIG. 5B is an electron microscope picture of size classified monodispersed 100 nm copper (Cu) particles obtained from an exemplary embodiment of the present invention.
Figure 5A:
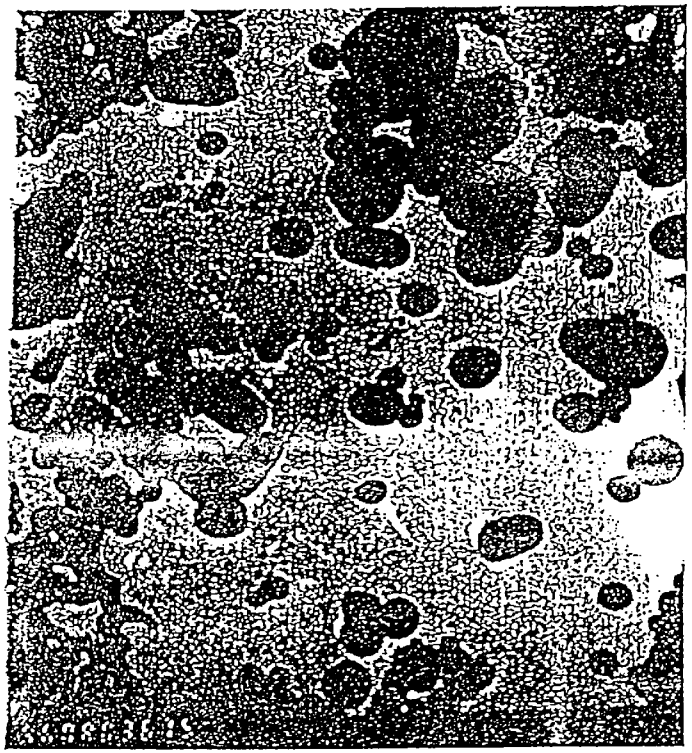

FIG. 5A is an electron microscope image of polydispersed copper particles, whereas FIG. 5B is an electron microscope image of monodispersed copper particles, having an approximate diameter of 100 nm. As evident by comparing FIG. 5A with FIG. 5B, the smaller particles diffuse more than that of the larger particles. The difference in diffusion amounts between the particle sizes is related to the operation of the DMA. In particular, the smaller particles diffuse more under the application of the electric field in the DMA, whereas the larger particles diffuse less. The decreased diffusion of the larger particles is attributed to the greater drag of associated with the larger particles.

EXAMPLES OF COPPER NANOPARTICLE PRODUCTION

Comparative Example 1

Figure 6A:
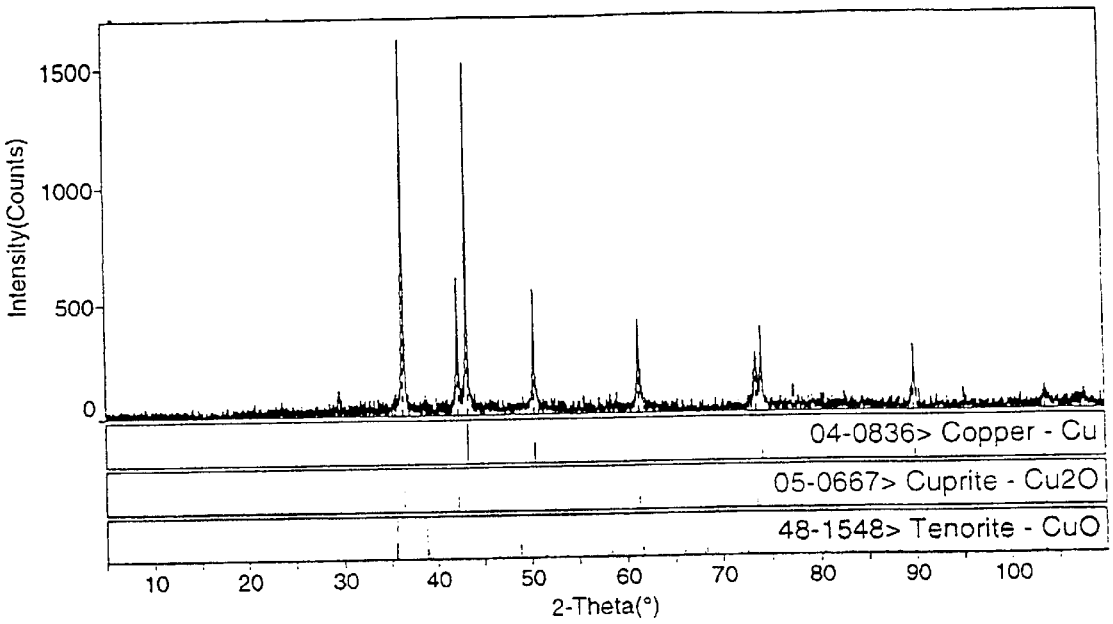

A spray pyrolysis system as depicted in FIG. 2, was used to process a solution of 0.35 M of copper nitrate in water. The aerosol of the solution was heated at 600° C. for 3.3 seconds, and the carrier gas used was nitrogen. FIG. 6A is a graph, and its associated data, depicting X-ray diffraction spectra of the particles formed by the spray pyrolysis system. A first material was experimentally found to have a 2-theta signature including angles of about 43.334°, 50.450°, 89.907°, and 95.154°. This 2-theta signature sufficiently matches the known 2-theta signature of pure copper. A second material was experimentally found to have a 2-theta signature including angles of about 29.576°, 36.417°, 42.322°, 61.397°, 73.550°, 77.391°, 92.518° and 103.647°. This 2-theta sign sufficiently matches the known 2-theta signature of $Cu_2O$. A third material was experimentally found to have a 2-theta signature including angles of about 32.523°, 35.584° and 38.821°. This 2-theta signature sufficiently matched the known 2-theta signature of CuO. Therefore, as experimentally confirmed, without using a co-solvent, the copper nitrate solution is reducible to a combination of Cu, CuO and $Cu_2O$.

Example 1

Figure 6B:
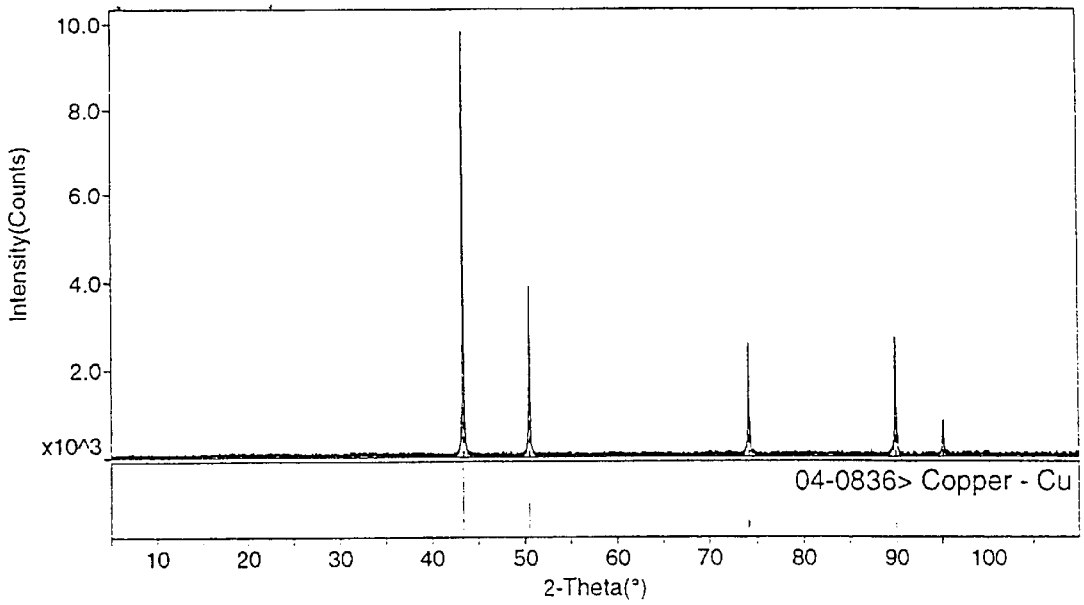
FIG. 6B is a graph depicting X-ray diffraction spectra of the resulting copper particles produced from a reduction of a solution of a copper nitrate, water and ethanol co-solvent in accordance with an embodiment of the present invention.

The spray pyrolysis system as depicted in FIG. 2, was then used to process a solution of 0.35 M of copper nitrate in a 10% ethanol, 90% water solution. The aerosol of the solution was heated at 600° C. for 3.3 seconds, and the carrier gas used was nitrogen. FIG. 6B is a graph, and its associated data, depicting X-ray diffraction spectra of the particles formed by the spray pyrolysis system. A single material was experimentally found to have a 2-theta signature including angles of about 43.343°, 50.479°, 89.960°, and 95.157°. This 2-theta signature sufficiently matches the known 2-theta signature of pure copper. Therefore, as experimentally confirmed, by using a co-solvent, the copper nitrate is reducible to solely pure copper particles.

Comparative Example 2

Figure 7A:
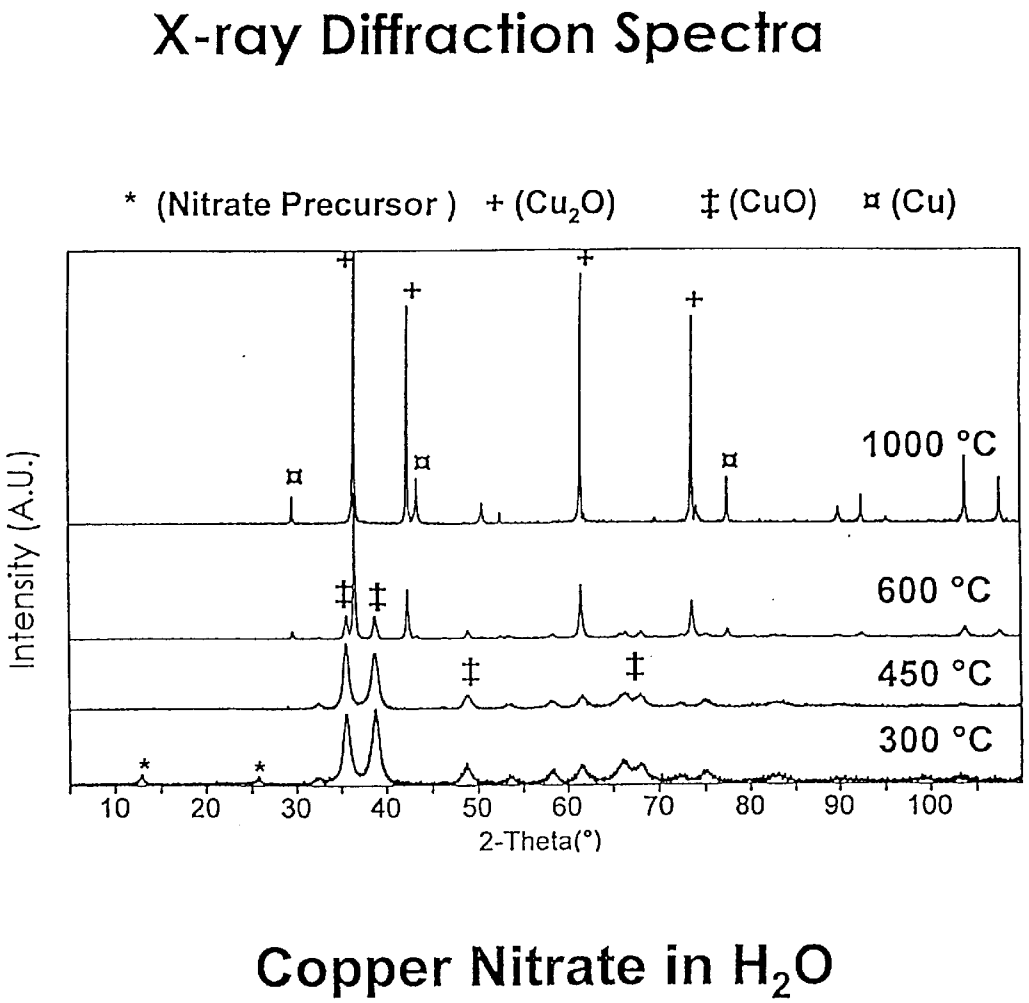

A spray pyrolysis system as depicted in FIG. 2, was used to process a solution of 0.3 M of copper nitrate in water. The aerosol of the solution was heated at 300° C., 450° C., 600° C. and 1000° C. for about 1.5 to about 3 seconds, respectively, and the carrier gas used was nitrogen. FIG. 7A is a graph depicting X-ray diffraction spectra of the resulting particles. As illustrated in the graph, even at a heating temperature of 1000° C., there are still produced amounts of $Cu_2O$ particles mixed with Cu particles.

The heating temperature alone may effect the reaction of a solution of a metal salt precursor used in a spray pyrolysis system. In particular, as the heating temperature increases, there is an enhancement in evaporation rate, decomposition rate and reduction rate. Furthermore, as the heating temperature increases, sintering increases.

The relationship between the particles produced and the heating temperatures used for a solution of copper nitrate and water used in a spray pyrolysis system is depicted below in Table 1. In the table, the majority composition of the particles produced from the spray pyrolysis system at the respective heating temperatures 300° C., 450° C., 600° C. and 1000° C., have been indicated in bold type.

TABLE 1

Effects of Reaction Temperature on Particle Production Using Copper Nitrate/Water Solution

| 300° C. | 450° C. | 600° C. | 1000° C. |
|---|---|---|---|
| CuO | CuO | CuO | |
| | $Cu_2O$ | $Cu_2O$ | $Cu_2O$ |
| | Cu | Cu | Cu |

Example 2

Figure 7B:
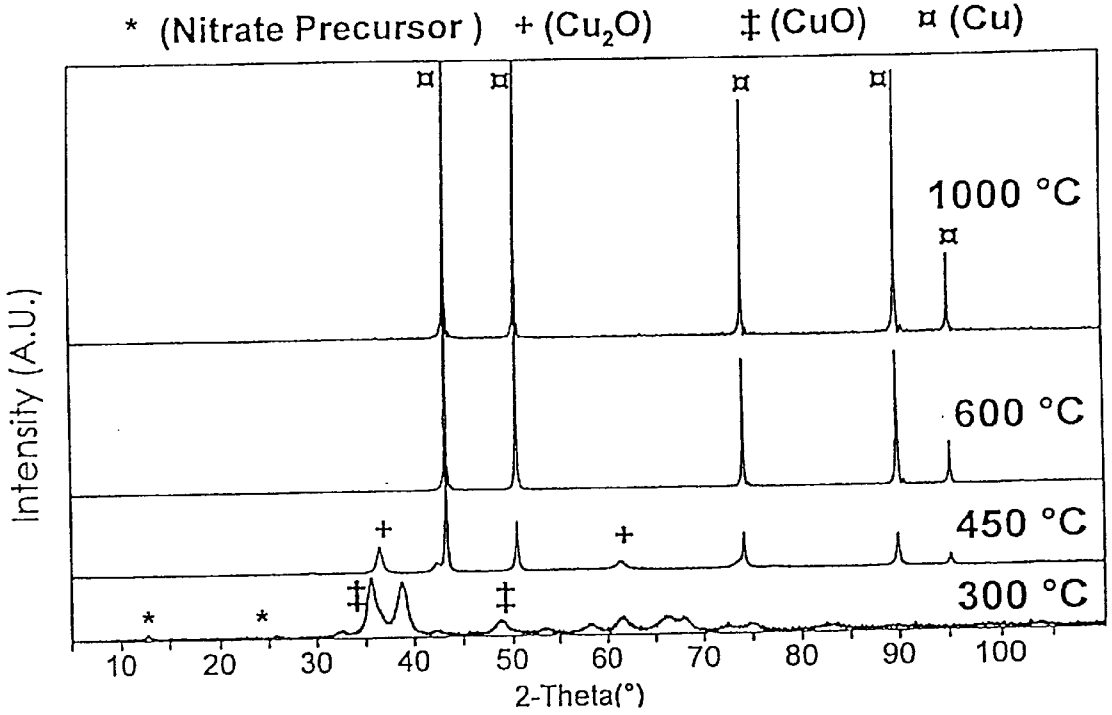
FIG. 7B is a graph depicting X-ray diffraction spectra of the resulting particles produced from a reduction of a solution of copper nitrate, water and an ethanol co-solvent in accordance with an embodiment of the present invention.

A spray pyrolysis system as depicted in FIG. 2, was used to process a solution of 0.3 M of copper nitrate in a 10% ethanol, 90% water solution. The aerosol of the solution was heated at 300° C., 450° C., 600° C. and 1000° C. for about 1.5 to about 3 seconds, respectively, and the carrier gas used was nitrogen. FIG. 7B is a graph depicting X-ray diffraction spectra of the resulting particles in accordance with an embodiment of the present invention. As illustrated in the graph, pure Cu is solely produced not only at 1000° C., but at the lower temperature 600° C.

Comparative Example 3

Figure 8A:
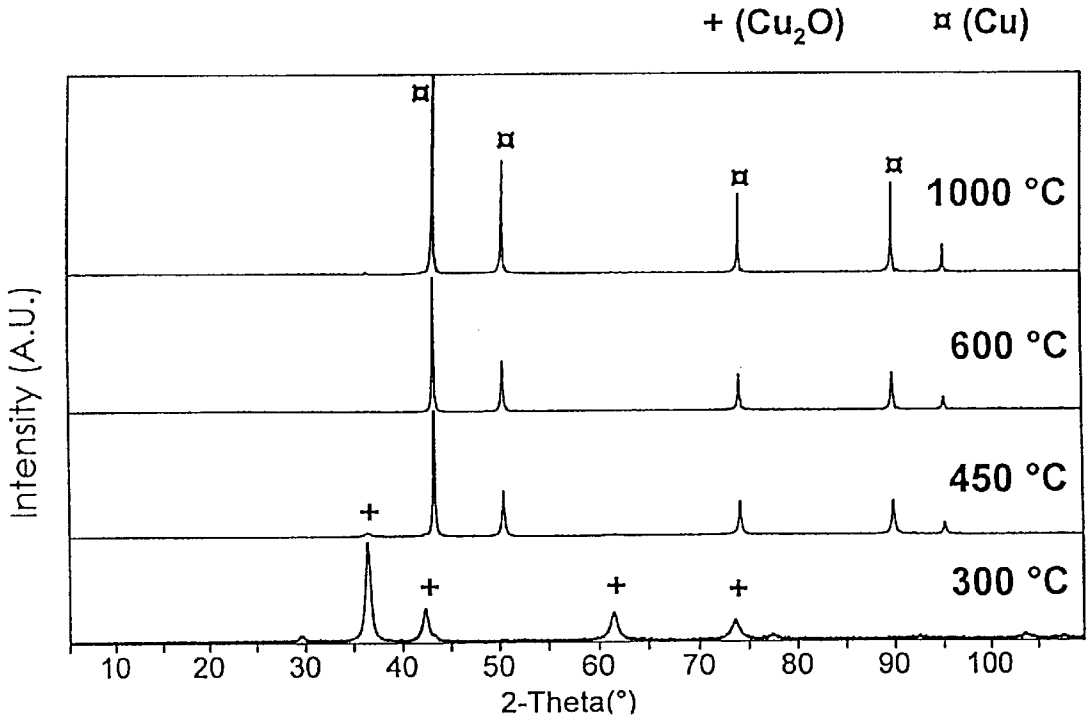

A spray pyrolysis system as depicted in FIG. 2, was used to process a solution of 0.3 M of copper acetate in water. The aerosol of the solution was heated at 300° C., 450° C., 600° C. and 1000° C. for about 1.5 to about 3 seconds, respectively, and the carrier gas used was nitrogen. FIG. 8A is a graph depicting X-ray diffraction spectra of the resulting particles. As illustrated at approximately a 2-theta measurement of 37° in the graph, at a heating temperature of 450° C., there are still produced amounts of $Cu_2O$ particles mixed with Cu particles.

Example 3

Figure 8B:
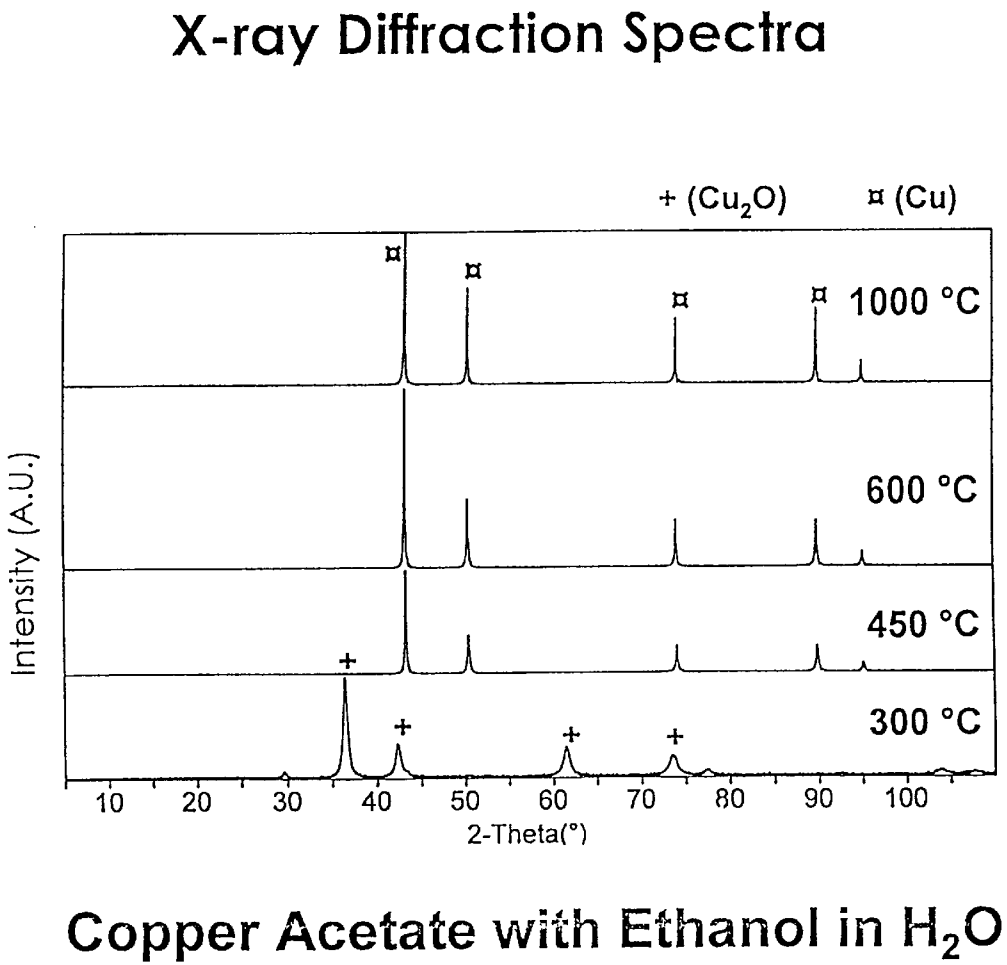
FIG. 8B is a graph depicting X-ray diffraction spectra of the resulting particles produced from a reduction of a solution of copper acetate, water and an ethanol co-solvent in accordance with an embodiment of the present invention.

A spray pyrolysis system as depicted in FIG. 2, was used to process a solution of 0.3 M of copper acetate in a 10% ethanol, 90% water solution. The aerosol of the solution was heated at 300° C., 450° C., 600° C. and 1000° C. for about 1.5 to about 3 seconds, respectively, used was nitrogen. FIG. 8B is a graph depicting X-ray diffraction spectra of the resulting particles in accordance with an embodiment of the present invention. As illustrated in the graph, pure Cu is solely produced not only at 600° C., but at the lower temperature 450° C.

Figure 9A:
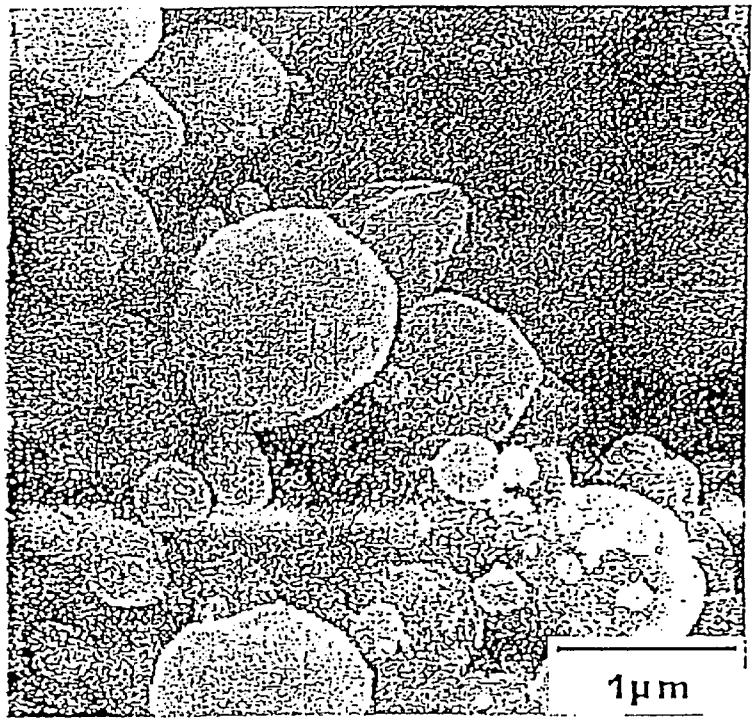
Figure 9B:
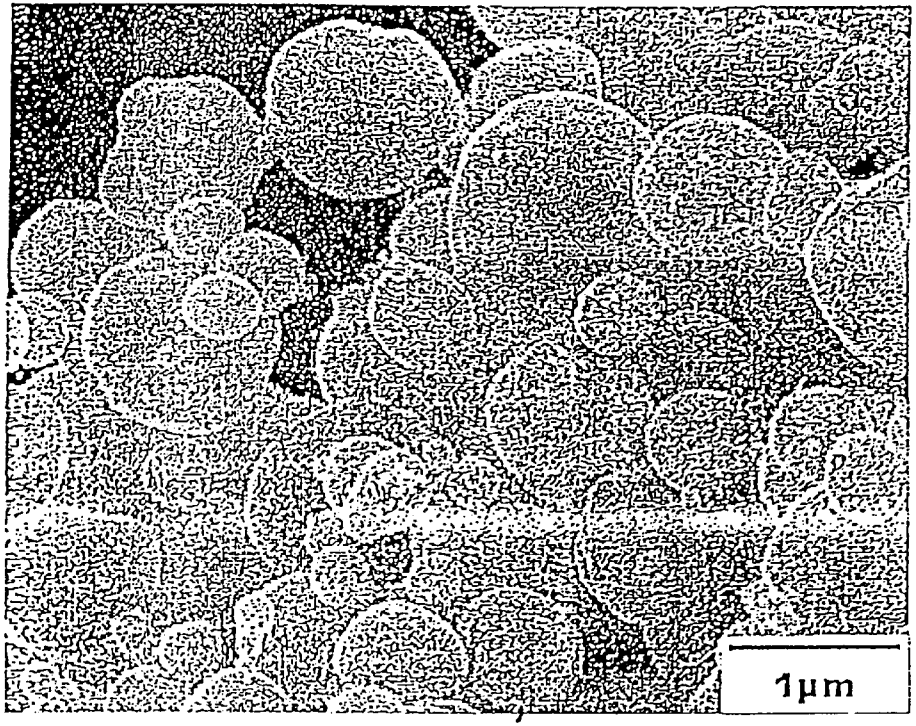
FIG. 9B is an electron microscope image of pure copper particles formed from copper nitrate with an ethanol co-solvent at a temperature of 1000° C. in accordance with an embodiment of the present invention.

FIG. 9A is a scanning electron microscope image of pure copper particles formed from copper nitrate with a co-solvent at a temperature of 600° C. in accordance with Example 2 of the present invention, whereas FIG. 9B is a scanning electron microscope image of pure copper particles formed from copper nitrate with a co-solvent at a temperature of 1000° C. in accordance with Example 2 of the present invention.

Examples of Nickel Nanoparticle Production

Figure 10:
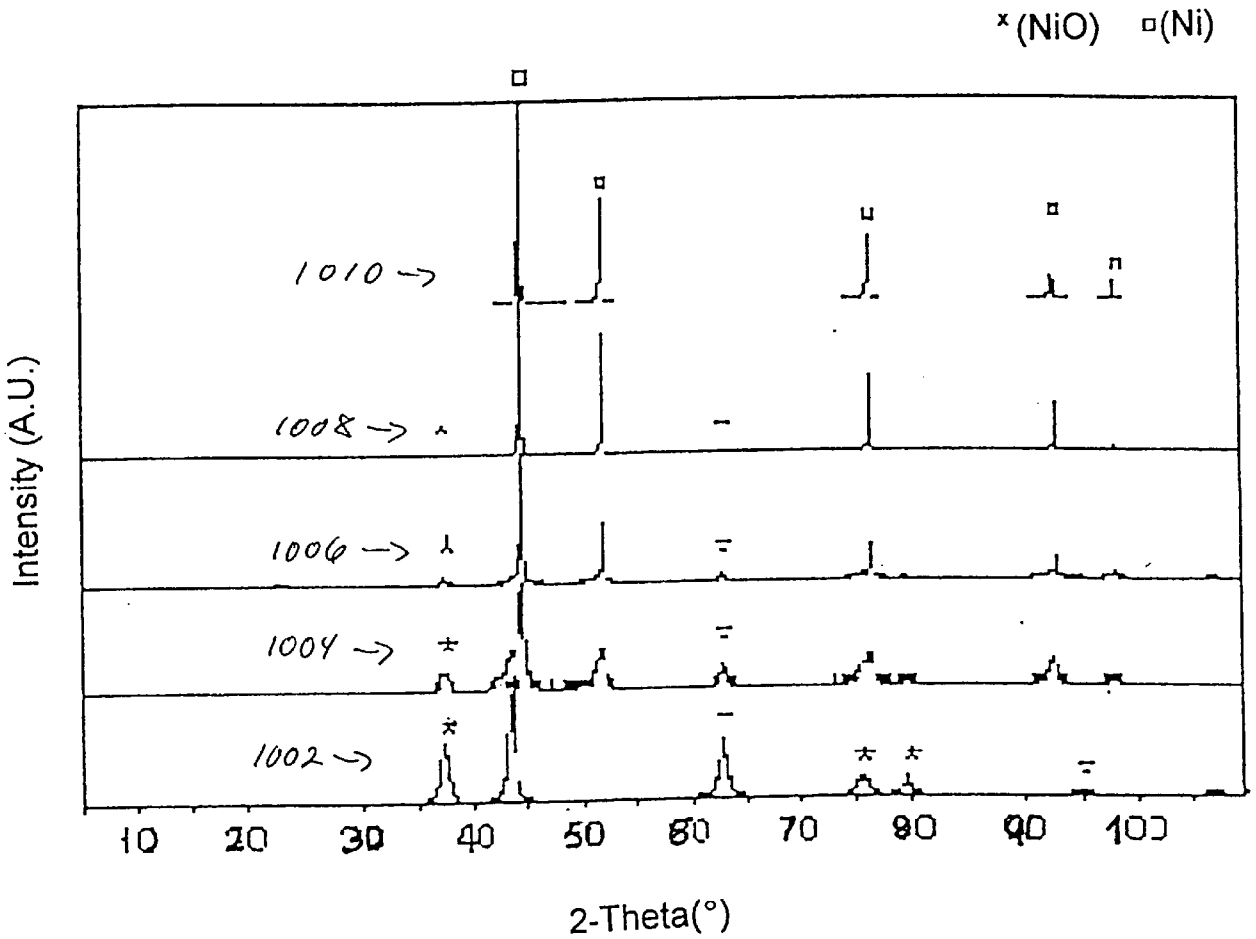
FIG. 10 is a plurality of graphs depicting X-ray diffraction spectra of particles resulting from a reduction of solutions of nickel nitrate and water, and nickel nitrate, water and ethanol.

A spray pyrolysis system as depicted in FIG. 2, was used to process a solution of 0.3 M of nickel nitrate in water, and 0.3 M solutions of nickel nitrate in ethanol and water. FIG. 10 is a plurality of graphs depicting X-ray diffraction spectra of particles resulting from a reduction of solutions.

Comparative Example 4

In particular, item 1002, of FIG. 10, is a graph that illustrates the resulting 2-theta signatures of particles resulting from a reduction of a solution of nickel nitrate and water as heated at 600° C. As indicated in the graph, the particles were experimentally found to have a 2-theta signature including angles of about 37.28°, 43.31°, 62.93°, 75.35°, 79.43° and 95.120. This 2-theta signature sufficiently matches the known 2-theta signature of NiO. Therefore, the particles experimentally proven to result from a reduction of a solution of nickel nitrate and water as heated at 600° C. were NiO particles.

Example 4

Item 1004, of FIG. 10, is a graph that illustrates the resulting 2-theta signatures of particles resulting from a reduction of a solution of nickel nitrate, water and 10% ethanol by volume of water as heated at 600° C. As indicated in the graph, the particles were experimentally found to have a 2-theta signature including angles of about 37.28°, 43.31°, 44.42°, 51.71°, 62.99°, 76.22°, 79.25°, 79.66° and 92.69°. Angles 37.28°, 43.31°, 62.99°, 79.25° and 79.66° sufficiently match the known 2-theta signature of NiO, whereas angles 44.42°, 51.71°, 76.22° and 92.69° sufficiently match the known 2-theta signature of Ni. Therefore, the 2-theta signature as depicted in item 1004 sufficiently matches a superposition of the known 2-theta signatures of NiO and pure Ni. Thus, as experimentally confirmed, by using a co-solvent in accordance with the present invention, pure nickel particles may be produced with a heating temperature of only 600° C.

Example 5

Item 1006, of FIG. 10, is a graph that illustrates the resulting 2-theta signatures of particles resulting from a reduction of a solution of nickel nitrate, water and 10% ethanol by volume of water as heated at 800° C. As indicated in the graph, the particles were experimentally found to have a 2-theta signature including angles of about 37.31°, 43.34°, 44.51°, 51.86°, 62.93°, 75.50°, 76.37°, 79.46°, 92.93°, 95.03° and 98.02°. Angles 37.31°, 43.34°, 62.93°, 75.50°, 79.46° and 95.03° sufficiently match the known 2-theta signature of NiO, whereas angles 44.51°, 51.86°, 76.37° and 92.93° sufficiently match the known 2-theta signature of Ni. Therefore, the 2-theta signature as depicted in item 1006 sufficiently matches a superposition of the known 2-theta signatures of NiO and pure Ni. By comparing items 1004 and 1006 of FIG. 10, it is evident that by increasing the heating temperature and using a co-solvent in accordance with the present invention, the amount of produced pure nickel particles may be increased, whereas the amount of NiO particles may be decreased.

Example 6

Item 1008, of FIG. 10, is a graph that illustrates the resulting 2-theta signatures of particles resulting from a reduction of a solution of nickel nitrate, water and 10% ethanol by volume of water as heated at 900° C. As indicated in the graph, the particles were experimentally found to have a 2-theta signature including angles of about 37.36°, 43.37°, 44.54°, 51.89°, 62.93°, 76.399°, 79.49°, 92.95°, 95.12° and 98.45°. Angles 37.36°, 43.37°, 62.93°, 79.49° and 95.12° sufficiently match the known 2-theta signature of NiO, whereas angles 44.54°, 51.89°, 76.399°, 92.95° and 98.45° sufficiently match the known 2-theta signature of Ni. Therefore, the 2-theta signature as depicted in item 1008 sufficiently matches a superposition of the known 2-theta signatures of NiO and pure Ni.

By comparing items 1004 through 1008 of FIG. 10, it is evident that by increasing the heating temperature and using a co-solvent in accordance with the present invention, the amount of produced pure nickel particles may be increased, whereas the amount of NiO particles may be decreased. Further, as evident in item 1008, by heating the solution at 900° C., the amount of NiO particles is minimal in comparison to the amount of pure Ni particles.

Example 7

Item 1010, of FIG. 10, is a graph that illustrates the resulting 2-theta signatures of particles resulting from a reduction of a solution of nickel nitrate, water and 30% ethanol by volume of water as heated at 900° C. As illustrated in the graph, item 1010 indicates that pure nickel particles were solely produced. As indicated in the graph, the particles were experimentally found to have a 2-theta signature including angles of about 44.51°, 51.86°, 76.34°, 92.84° and 98.33°, all of which sufficiently match the known 2-theta signature of Ni. Therefore, the 2-theta signature as depicted in item 1010 sufficiently matches the known 2-theta signature of pure Ni. Thus, as experimentally determined, by using a 30% by volume co-solvent in accordance with the present invention, pure nickel particles may solely be produced with a heating temperature of 900° C.

The foregoing description of various preferred embodiments of the invention have been presented for purposes of illustration and description. It is not intended to be exhaustive or to limit the invention to the precise forms disclosed, and obviously many modifications and variations are possible in light of the above teaching. The exemplary embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of producing metal particles comprising:

generating aerosol droplets of a solution in an inert carrier gas; and heating the aerosol droplets with a heater to form metal particles, wherein the solution comprises a metal precursor, water and a co-solvent acting as a reducing agent.

2. The method of claim 1, wherein the metal precursor comprises any one of the group consisting of Fe, Co, Ni, Cu, Zn, Pd, Ag and Au.

3. The method of claim 1, wherein the metal precursor comprises Cu or Ni.

4. The method of claim 1, wherein the co-solvent reducing agent is an organic compound having 1 to 5 carbon atoms.

5. The method of claim 1, wherein the co-solvent is an alcohol.

6. The method of claim 5, wherein the alcohol is present in an amount of about 1% to about 50% by volume of the solution.

7. The method of claim 1, wherein the co-solvent is methanol or ethanol.

8. The method of claim 1, wherein the metal precursor is present in an amount of about 0.001 mol/liter to about 95% of the saturation limit of the metal precursor in the solution.

9. The method of claim 1, wherein the metal particles are pure metal nanoparticles.

10. The method of claim 1, wherein the metal particles have a diameter within the range of about 50 nm to about 200 nm.

11. The method of claim 1, wherein the water is deionized water.

12. The method of claim 1, wherein the inert carrier gas comprises nitrogen gas.

13. The method of claim 1, further comprising passing the heated aerosol through a bipolar charger to obtain metal particles with a Boltzmann charge distribution.

14. The method of claim 13, further comprising passing the heated aerosol through a differential mobility analyzer.

15. The method of claim 14, further comprising passing the metal particles to an electrostatic precipitator for particle deposition.

16. The method of claim 1, wherein said step of generating aerosol droplets of a solution further comprises flowing the solution into an atomizer at a flow rate of 20 mL/hr, flowing the inert carrier gas into the atomizer at flow rate of 5 L/min, and atomizing the solution and the inert carrier gas with the atomizer.

17. The method of claim 1, wherein said step of heating comprises passing the aerosol through a two-zone furnace thereby forming metal particles by solvent evaporation and precursor decomposition.

18. The method of claim 1, wherein said step of heating is conducted at a temperature within the range from about 300° C. to about 1600° C.

19. The method of claim 1, wherein said step of heating is conducted at a temperature within the range from about 450° C. to about 800° C.

20. The method of claim 1, further comprising drying the aerosol droplets prior to heating.

21. The method of claim 20, wherein said step of drying comprises passing the aerosol droplets through a screen having a desiccant deposited thereon.

22. A product coated with metal particles, wherein the metal particles are produced by the method of claim 1.

23. The method of claim 1, wherein the co-solvent acts as a reducing agent during said heating.

* * * * *